US006276178B1

(12) United States Patent
West et al.

(10) Patent No.: US 6,276,178 B1
(45) Date of Patent: Aug. 21, 2001

(54) OPEN MESH FABRIC STRUCTURE WITH STAND-OFF DESIGN

(75) Inventors: Roger Donald West, Madison; Marks S. Arsenault, Ruckersville; Paul A. J. Gascoyne, Gordonsville, all of VA (US)

(73) Assignee: Liberty Fabrics, Gordonsville, VA (US)

( * ) Notice: Subject to any disclaimer, the term of this patent is extended or adjusted under 35 U.S.C. 154(b) by 0 days.

(21) Appl. No.: 09/565,476

(22) Filed: May 5, 2000

(51) Int. Cl.[7] ..... D04B 23/06
(52) U.S. Cl. ..... 66/193; 66/195
(58) Field of Search ..... 66/190, 191, 192, 66/193, 195, 196, 202; 442/306, 312, 314

(56) References Cited

U.S. PATENT DOCUMENTS

| | | | |
|---|---|---|---|
| 2,249,342 | 7/1941 | Aull | 6/195 |
| 2,411,175 | 11/1946 | Wagler | 66/198 |
| 4,015,451 | 4/1977 | Gajjar | 66/195 |
| 4,103,485 | 8/1978 | Brues | 66/192 |
| 4,527,404 | 7/1985 | Nakagaki et al. | 66/202 |
| 4,748,078 | 5/1988 | Doi et al. | 428/245 |
| 5,385,036 | 1/1995 | Spillane et al. | 66/87 |
| 5,601,907 | 2/1997 | Matsumoto | 442/1 |
| 5,732,573 | 3/1998 | Sexton | 66/195 |
| 5,888,914 | 3/1999 | Katz | 442/184 |

FOREIGN PATENT DOCUMENTS

| | | | |
|---|---|---|---|
| 3006194 | 9/1980 | (DE) | 66/192 |

*Primary Examiner*—Danny Worrell
(74) *Attorney, Agent, or Firm*—Kenyon & Kenyon

(57) ABSTRACT

A fabric with an open mesh structure includes raised members that effectively separate the wearer from the fabric base. The raised members add a third dimension of depth or thickness to a traditionally two-dimensional piece of apparel allowing the fabric base to remain separate from the wearer's body which provides greater comfort and breathability to the wearer. The raised members are placed in useful proportion with the open holes and closed spaces of the fabric enhancing the quality and functionality of the apparel.

28 Claims, 5 Drawing Sheets

OPEN MESH FABRIC STRUCTURE WITH STAND-OFF DESIGN

BACKGROUND OF THE INVENTION

1. Field of the Invention

The present invention generally relates to warp knitted fabrics. It particularly relates to an open mesh structure with a stand-off design for athletic apparel.

2. Background Art

When an athlete performs, perspiration from the athlete's body may lead to a "sticky" feeling when the perspiration lingers on the skin surface. Consequently, many athletes wear mesh jerseys (e.g., football, track, soccer, hockey, etc.) that have open holes in the jersey fabric (open mesh design) allowing perspiration to escape from the skin surface through the holes in the athletic garment. These mesh jerseys and other garments provide greater personal comfort and a more breathable environment to the high-performance perspiring athlete. Many such open mesh garments are produced, for example, using warp knitting machines.

Warp knitted open mesh structures known in the art (such as the well known "Football Mesh" Jersey) are often constructed of, for example, at least two continuous filament synthetic yarns such as nylon or polyester. Such yarns may be carried, for example, by two guide bars of a warp knitting machine. The fabric may be stitched using a variation of the Atlas technique wherein both guide bars knit in opposite directions leaving clean holes in the fabric. Such clean holes may be created in the mesh design by using ground yarns that do not knit on the same needle therein leaving subsequent repetitive courses knitted without a connection between the two adjacent needles. The resulting fabric has the known open hole mesh structure. Commonly, the resulting fabric has a flat surface with a population of open holes staggered throughout but spaced equidistantly, while the non-hole solid closed portions generally comprise approximately 50% of the remaining fabric surface.

Despite the afore-mentioned moisture reduction qualities, the base of the open mesh jersey fabric still lays directly on the skin of wearer, often resulting liquid saturation of the jersey after perhaps minimal use. When perspiration occurs, the fabric may become heavier with sweat content, stick to the wearer, or otherwise cease to comfortable athletic apparel. Therefore, there is a need for an athletic jersey design providing greater comfort and breathability to the athlete.

SUMMARY OF THE INVENTION

The present invention overcomes the previously mentioned disadvantages by providing an open hole mesh fabric structure with a stand-off design. In accordance with the present invention, the open hole mesh fabric includes raised members positioned at a different height (depth) from the fabric base which effectively separates a major portion of the fabric from the wearer. The fabric may be knitted on a warp knitting machine having at least five guide bars, wherein one guide bar may be, for example, a Jacquard guide bar. A warp knitting machine including a Jacquard guide bar is described in U.S. Pat. No. 5,628,210 to Mista et al., entitled WARP KNITTING METHOD, MACHINE, AND FABRIC MADE THEREFROM.

In accordance with the present invention, a traditional two-dimensional open hole mesh fabric is particularly knitted with raised members that stand at a different height than the fabric base on the technical back of the fabric. The raised members add a third dimension of depth or thickness to the fabric and are knitted in the solid areas between the open holes of the fabric located in the fabric base. Advantageously, the raised members are the only portions of the fabric which contact the fabric wearer during fabric use wherein the number of members are placed in a predetermined, appropriate ratio with the number of holes located in the fabric base. These raised fabric members may also be referred to as "raised dots" or "high-density support sections".

The three-dimensional fabric structure enables the ground structure or base of the fabric to be suspended from (i.e., stand-off) the wearer's body thereby significantly reducing the surface area and volume of fabric material contacting the skin surface. The separation of the fabric base from the wearer's skin provides a superior level of comfort and breathability to the apparel user. The comfort and convenience of the apparel fabric may be further enhanced by selecting fabric materials with hydrophilic or hydrophobic properties. These advantageous materials include, but are not limited to continuous filament synthetic polyester and nylon yarn material. Also, chemical finishes and treatments may be added to the fabric to enhance apparel functionality.

DETAILED DESCRIPTION

A preferred embodiment of a fabric according to the present invention may be constructed using a warp knitting machine having at least five guide bars. The exemplary knitting machine may include a plurality of pattern bars wherein at least two different groups of pattern bars are selected from the plurality of available frontmost pattern bars. Also, in a preferred embodiment, the fabric may have a repeat length of 28 stitches and a repeat width of 16 needles, although any suitable repeat length or width may be used.

Figure 1:
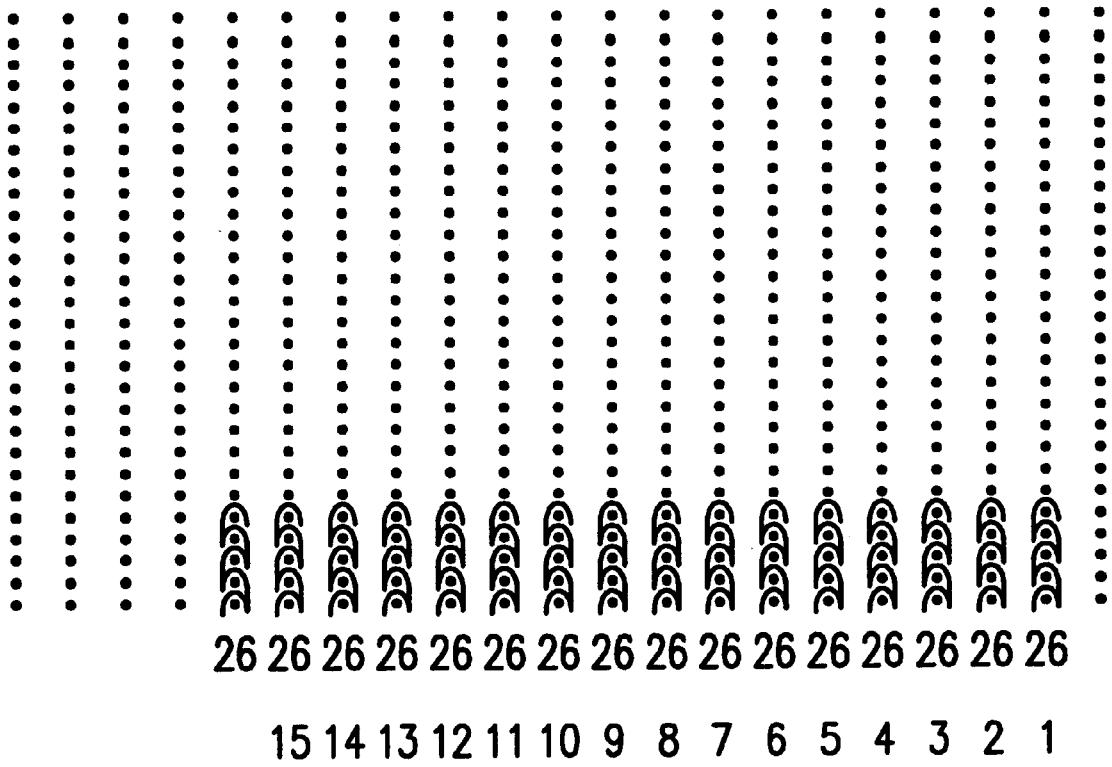
FIG. 1 is an exemplary stitch diagram illustrating a stitch pattern of a ground yarn of a fabric according to the present invention.
Figure 2:
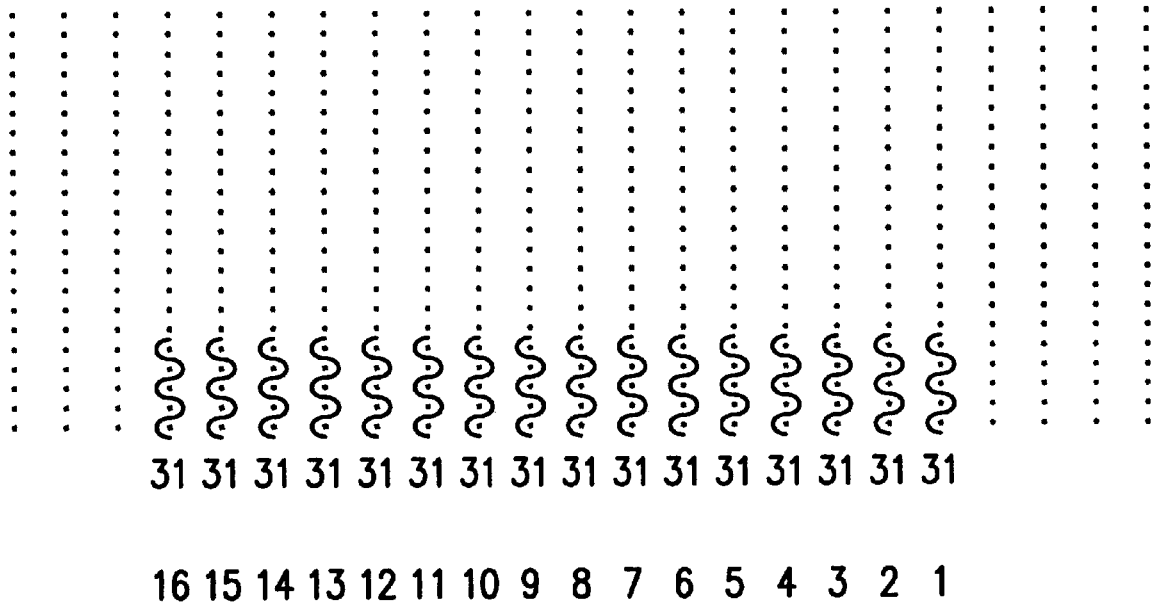
FIG. 2 is an exemplary stitch diagram illustrating a stitch pattern of an elastomeric yarn of a fabric according to the present invention.

FIGS. 1 and 2 illustrate exemplary stitch patterns for a "ground" yarn and an "elastomeric" yarn for use in constructing a fabric according to the present invention. In constructing a fabric according to the present invention, a preferred knitting machine includes guide bars #4 and #5 that knit the ground yarn and the elastomeric yarn to form a base fabric construction. Preferably, guide bar #4 is a fully threaded ground bar that stitches the ground yarn in an exemplary stitch pattern as shown in FIG. 1, using a preferred chain stitch, although any suitable stitch may be used. Guide bar #5 (the backmost bar in the illustrated example) advantageously lays a LYCRA spandex yarn or other elastomeric yarn into the fabric, as shown in FIG. 2.

Figure 3:
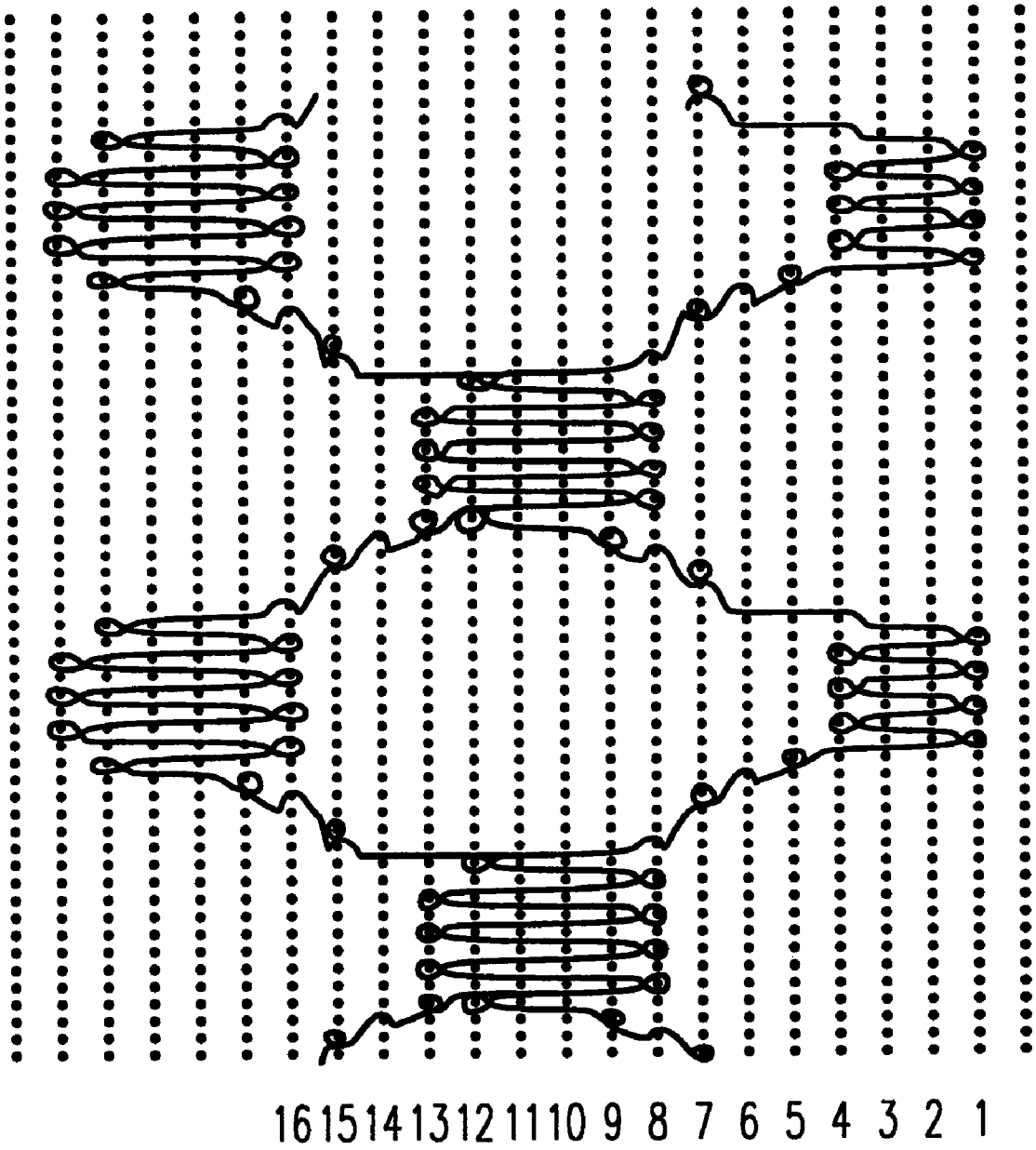
FIG. 3 is an exemplary diagram illustrating a stitch pattern of a first and second threaded yarns of a fabric according to the present invention.

FIG. 3 provides a stitch diagram showing the stitching patterns for a first threaded yarn and a second threaded yarn of a fabric according to the present invention. The first and second threaded yarns may be carried by guide bars #1 and #2 of an exemplary knitting machine such as that described above. Guide bars #1 and #2 may include, for example, 24 pattern bars, wherein the group of pattern bars 1–12 (the frontmost group) comprise guide bar #1 and the group of pattern bars 13–24 (the second frontmost group) comprise guide bar #2. Also, in this exemplary embodiment, guide bars #1 and #2 are positioned such that guide bar #1 stitches on top of guide bar #2 during knitting. The stitching patterns followed by these guides bars help create the raised members of the present invention.

As shown in FIG. 3, both guide bars #1 and #2 preferably knit first and second threaded yarns, respectively. Guide bar #1 may form a float of a magnitude equaling, for example, 6 needles (5 needle spaces) while guide bar #2 may make a float of a shorter magnitude equaling, for example, 4 needles (3 needle spaces) at the same time and location in the fabric so that the two floats overlap. Floats of other magnitudes may be utilized as well. Guide bars #1 and #2 may preferably be threaded in a 1-in, 15-out arrangement.

As the fabric relaxes during and after knitting, the floats formed by guide bar #1 "collapse" (i.e., contract to a smaller width and/or increased density) from the fabric base and stand erect from the ground structure of the fabric in the form of raised members 10, 12. These raised members (10,12) may be referred to as "raised dots" or "high-density support sections. In concerted action with guide bar #1, the floats formed by guide bar #2 both support and help push the raised members (10,12) away from the fabric base structure thereby maximizing the height and thickness of the raised members. These raised members (10,12) may take the form of "croquet hoops" or "McDonald Arches". It is noted that these terms and other alternative terms used herein are being used for purposes of clarity, and should not be construed as limitations on the present invention, and that the raised members (10,12) may be formed in any suitable shape using different float lengths, yarns and other variables as understood by one skilled in the art.

Figure 4:
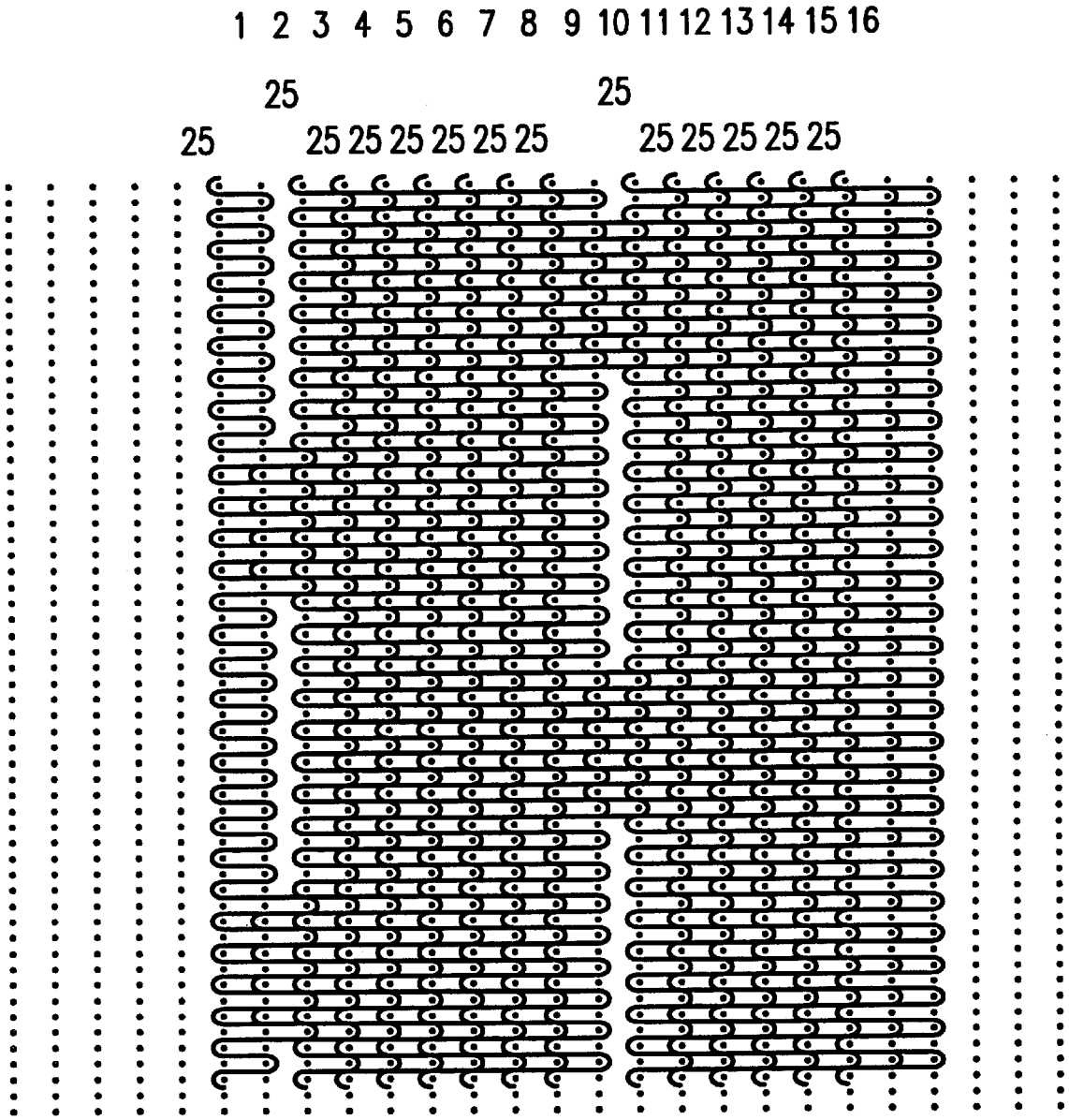
FIG. 4 is a stitch diagram illustrating a stitch pattern of a Jacquard yarn of a fabric according to the present invention.

In accordance with an embodiment of the present invention, a Jacquard bar, which is either a single bar or, as illustrated, a compound set of 2 bars, is designated as guide bar #3 (in the next position following guide bars #1 and #2) and may knit a Jacquard yarn in an exemplary stitching pattern as shown in FIG. 4. As illustrated in FIG. 4, the Jacquard bar (guide bar #3) preferably follows a stitching pattern that creates open holes in the fabric. In concerted action with guide bar #3, the raised members formed by guide bars #1 and #2 advantageously alternate with the open holes formed by the Jacquard yarn, wherein the raised members are positioned in the closed spaces (no open holes) of the fabric base. In a preferred embodiment, the formation of the open holes may be independently controlled such that the population of raised members to open holes in the fabric follows a useful, pre-determined ratio ensuring apparel quality and functionality.

In constructing a fabric according to the present invention, a warp knitting machine is preferably provided with a fall plate located in the next position following guide bar #3. The fall plate functions to help lift and position both the first and second threaded yarns being knitted by guide bars #1 and #2 (forming floats and raised members) and the Jacquard yarn being knitted by guide bar #3 to the technical back of the fabric. This function of the fall plate helps ensure that the raised members are predominately located on the technical back of the fabric structure while also ensuring that the technical face side of the fabric structure is smooth and clean (traditional two-dimensional form). This action also helps to ensure the aesthetic quality of the garment's outer face. Advantageously, the raised members on the technical back of the fabric contact the wearer, thereby forcing most or all of the ground structure away from the wearer and enabling convenient and comfortable use of the garment. The open holes in the invention fabric allow efficient discharge of moisture for enhanced comfort to the wearer.

Any suitable yarns may be used to form a fabric according to the present invention. It is understood in this respect that the terms "threaded yam", "Jacquard yarn", "ground yarn", and "elastomeric yarn" are purely used for convenience and clarity, and are not meant to imply or create any limitation of the present invention. Preferably, the first and second threaded yarns may be 5 ply to 8 ply synthetic continuous flat filament or textured nylon yarns. These yarns may comprise a multifilament yarn of 30 to 150 denier and a filament count of 10 to 200 filaments. In a particularly preferred embodiment, a relatively heavy 8 ply 70/34 textured nylon may be used. These yarns force the floats to collapse resulting in the raised members (standing off from the fabric base) of the invention fabric.

Similarly, the Jacquard yarn may preferably be a synthetic continuous flat filament or textured nylon yarn (multifilament) of 10 to 100 denier and a filament count of 5 to 150 filaments. The ground yarn may be a synthetic continuous flat filament or textured nylon yarn (multifilament) of approximately 20 to 150 denier and a filament count of approximately 5 to 200 filaments. The elastomeric yarn is preferably a spandex yarn (synthetic continuous filament) of 40 to 400 denier, a preferred width being 140 denier.

Figure 5:
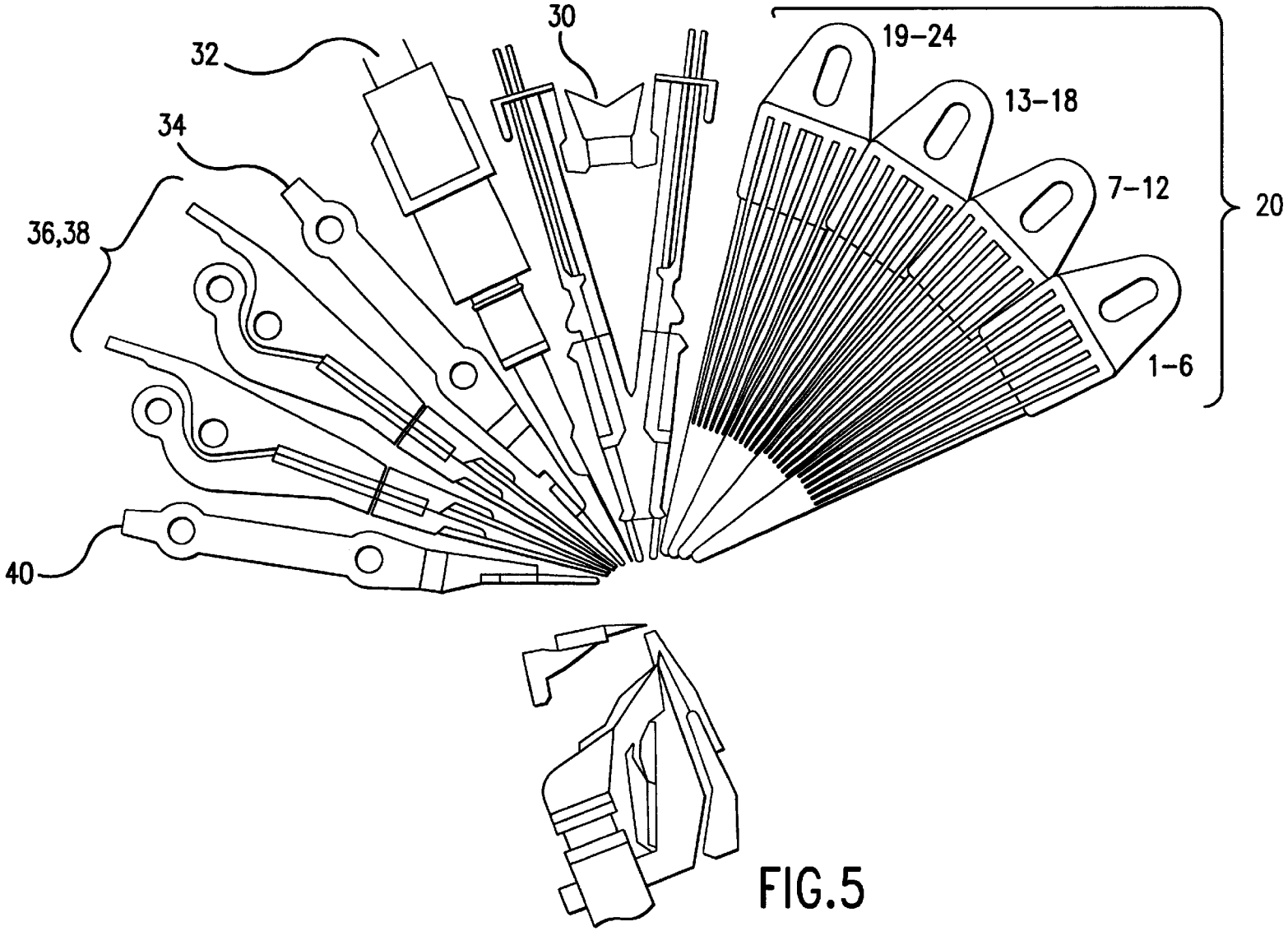
FIG. 5 is a diagram of an exemplary guide bar configuration for construction of a fabric according to the present invention.

In accordance with the present invention, the fabric described herein may be formed using a multi-bar Raschel Warp Knit Machine, preferably on the Textronic type MRSEJF 31/1/24 (24 gauge) which is sold and manufactured by Karl Mayer Textile Machine in Obershausen, Germany. As shown in FIG. 5, this exemplary warp knitting machine is a 31 bar machine that includes 24 guide bars (20) in the frontmost positions numbered 1–24, two Jacquard compound bars (30) in positions 2–26, and a fall plate (32) in the $27^{th}$ bar position. Also, the machine includes a ground stitching bar (34) in position 28, two "inlay" bars (36, 38) in positions 29–30 (which need not be used with the present invention), and a backmost Lycra bar (40) in position 31 for the elastomeric yarn.

In another embodiment in accordance with the present invention, the fabric described herein may be reproduced using an alternative warp knitting machine, an example being the Karl Mayer Textronic Type MRSEJF 53/1/24. This machine has the Jacquard bar positioned behind the fall plate (rather than in front of the fall plate) enabling the raised member design to be produced wherein the yam knitted by the Jacquard bar is not forced to the technical back of the fabric. Again, it is understood that these warp knitting machines are exemplary and the present invention is in no way limited to the two described knitting machines.

Also, in accordance with the present invention, the fabric construction process may include chemical applications to further enhance apparel quality and performance. The chemical applications may include, but are not limited to hydrophobic applications such as Zonyl 7040 (a product of CIBA Chemical), Zepel (a product of Dupont), Scotchgard (a product of 3M Company), chemical coating, and laminating. A fabric according to the present invention may include any useful combination of the raised member design, yarn ingredient selection, and chemical applications.

It is noted that those skilled in the art can understand that the invention fabric described herein is not limited to sports applications. Additional applications of the present invention may include, but are not limited to general medical and sports medicine uses. Therefore, any further uses of the invention fabric described herein are contemplated here and are within the scope of the invention.

It is similarly noted that those skilled in the art will understand that the invention fabric may be constructed using additional guide bars and/or pattern bars. Also, the fabric of the present invention may of course include more features such as additional yarn elements. This list of additional features is not exclusive, and it is to be understood that any such embodiments are contemplated here and are within the scope of the present invention.

What is claimed is:

1. A fabric, comprising:

a ground yarn being knitted in a chain sequence;

a Jacquard yarn being knitted to form holes in the fabric;

a first threaded yarn being knitted to form first floats;

a second threaded yarn being knitted to form second floats, wherein the first floats and the second floats overlap and wherein the first and second floats have different magnitudes, at least one of the first and second floats contracting to form raised members.

2. The fabric of claim 1, wherein the first and second threaded yarns are multifilament yarns between 5 ply to 8 ply, of 30 to 150 denier, and having 10 to 200 filaments.

3. The fabric of claim 1, wherein the first and second threaded yarns are either a continuous flat filament or a textured nylon.

4. The fabric of claim 1, further comprising an elastomeric yarn being laid into the fabric.

5. The fabric of claim 1, wherein the ground yarn is a multifilament yarn of 20 to 150 denier, and having 5 to 200 filaments, and the elastomeric yarn is an elastic continuous filament of 40 to 400 denier.

6. The fabric claim 1, wherein the ground yarn is either a continuous flat filament or textured nylon.

7. The fabric of claim 1, wherein the Jacquard yarn is a multifilament yarn of 10 to 100 denier, and having 5 to 200 filaments.

8. The fabric of claim 1, wherein the Jacquard yarn is either a continuous flat filament or textured nylon.

9. The fabric of claim 1, wherein at least the first and second threaded yarn are arranged on the technical face of the fabric such that the raised members stand off the technical face of the fabric.

10. The fabric of claim 1, wherein the fabric has a repeat length of approximately 28 stitches.

11. The fabric of claim 1, wherein the fabric has a repeat width of approximately 16 needles.

12. The fabric of claim 1, wherein the magnitude of the first floats exceeds the magnitude of the second floats by at least two needle spaces.

13. The fabric of claim 1, wherein the fabric is produced using one of a 31 bar warp knitting machine and a 53 bar warp knitting machine.

14. The fabric of claim 13, wherein the first yarn and second threaded yarns are threaded with a 1-in, 15-out arrangement on at least two guide bars of the warp knitting machine.

15. A method of forming a fabric, comprising:

knitting a ground yam in a chain sequence;

knitting a Jacquard yarn to form holes in the fabric;

knitting a first threaded yarn to form first floats;

knitting a second threaded yarn to form second floats, where the first floats and the second floats overlap, and when the first and second floats have different magnitudes, at least one of the first and second floats contracting to form raised members.

16. The method of claim 15, wherein the first and second threaded yarns are multifilament yarns between 5 ply to 8 ply, of 30 to 150 denier, and having 10 to 200 filaments.

17. The method of claim 15, wherein the first and second threaded yarns are either a continuous flat filament or a textured nylon.

18. The method of claim 15, further comprising laying an elastomeric yarn into the fabric.

19. The method of claim 15, wherein the ground yarn is a multifilament yarn of 20 to 150 denier, and having 5 to 200 filaments, and the elastomeric yarn is an elastic continuous filament of 40 to 400 denier.

20. The method of claim 15, wherein the ground yarn is either a continuous flat filament or textured nylon.

21. The method of claim 15, wherein the Jacquard yarn is a multifilament yarn of 10 to 100 denier, and having 5 to 200 filaments.

22. The method of claim 15, wherein the Jacquard yarn is either a continuous flat filament or textured nylon.

23. The method of claim 15, wherein at least the first and second threaded yarn are arranged on the technical face of the fabric such that the raised members stand off the technical face of the fabric.

24. The method of claim 15, wherein the fabric has a repeat length of approximately 28 stitches.

25. The method of claim 15, wherein the fabric has a repeat width of approximately 16 needles.

26. The fabric of claim 15, wherein the magnitude of the first floats exceeds the magnitude of the second floats by at least two needle spaces.

27. The fabric of claim 15, wherein the fabric is produced using one of a 31 bar warp knitting machine and a 53 bar warp knitting machine.

28. The fabric of claim 27, wherein the first yarn and second threaded yarns are threaded with a 1-in, 15-out arrangement on at least two guide bars of the warp knitting machine.

* * * * *

UNITED STATES PATENT AND TRADEMARK OFFICE

CERTIFICATE OF CORRECTION

PATENT NO. : 6,276,178 B1
DATED : August 21, 2001
INVENTOR(S) : Roger Donald West et al.

It is certified that error appears in the above-identified patent and that said Letters Patent is hereby corrected as shown below:

Column 4,
Line 53, change "yam" to -- yarn --.

Column 6,
Line 9, change "yam" to -- yarn --.

Signed and Sealed this

Thirtieth Day of April, 2002

*Attest:*

*Attesting Officer*

JAMES E. ROGAN
*Director of the United States Patent and Trademark Office*